US006872052B2

(12) United States Patent
Havel et al.

(10) Patent No.: US 6,872,052 B2
(45) Date of Patent: Mar. 29, 2005

(54) HIGH-FLOW LOW TORQUE FAN

(75) Inventors: Brian Havel, London (CA); Bonifacio Castillo, London (CA)

(73) Assignee: Siemens VDO Automotive Inc., Chatham (CA)

( * ) Notice: Subject to any disclaimer, the term of this patent is extended or adjusted under 35 U.S.C. 154(b) by 132 days.

(21) Appl. No.: 10/454,928

(22) Filed: Jun. 5, 2003

(65) Prior Publication Data

US 2004/0175270 A1 Sep. 9, 2004

Related U.S. Application Data

(60) Provisional application No. 60/453,119, filed on Mar. 7, 2003.

(51) Int. Cl.[7] ..... F04D 29/38

(52) U.S. Cl. ..... 416/189; 416/223 R; 416/DIG. 5

(58) Field of Search ..... 416/55, 169 A, 416/189, 195, 223 R, DIG. 2, DIG. 5

(56) References Cited

U.S. PATENT DOCUMENTS

| | | | | | |
|---|---|---|---|---|---|
| 4,358,245 | A | | 11/1982 | Gray | 416/189 |
| 4,568,242 | A | | 2/1986 | Susa et al. | 415/213 |
| 4,569,632 | A | * | 2/1986 | Gray, III | 416/189 |
| 4,684,324 | A | | 8/1987 | Perosino | 416/189 |
| 4,915,588 | A | | 4/1990 | Brackett | 416/189 |
| 5,244,347 | A | | 9/1993 | Gallivan et al. | 416/189 |
| 5,326,225 | A | * | 7/1994 | Gallivan et al. | 416/189 |
| 5,513,951 | A | | 5/1996 | Komoda et al. | 415/119 |
| 5,577,888 | A | | 11/1996 | Capdevila et al. | 415/220 |
| 5,588,804 | A | | 12/1996 | Neely et al. | 416/223 |
| 5,624,234 | A | | 4/1997 | Neely et al. | 416/238 |
| 5,755,557 | A | | 5/1998 | Alizadeh | 416/193 |
| 5,769,607 | A | | 6/1998 | Neely et al. | 416/189 |
| 5,957,661 | A | | 9/1999 | Hunt et al. | 416/192 |
| 5,961,289 | A | | 10/1999 | Lohmann | 416/189 |
| 5,996,685 | A | | 12/1999 | Alizadeh | 165/121 |
| 6,065,937 | A | | 5/2000 | Hunt | 416/189 |
| 6,241,474 | B1 | | 6/2001 | Alizadeh | 416/189 |
| 6,254,342 | B1 | | 7/2001 | Fujinaka et al. | 415/208.5 |
| 6,287,078 | B1 | | 9/2001 | Min et al. | 416/189 |
| 6,350,104 | B1 | | 2/2002 | Moreau et al. | 416/192 |
| 6,368,061 | B1 | | 4/2002 | Capdevila | 416/169 |
| 6,375,427 | B1 | | 4/2002 | Williams et al. | 416/169 |
| 2003/0026699 | A1 | * | 2/2003 | Stairs et al. | 416/192 |

* cited by examiner

*Primary Examiner*—Edward K. Look
*Assistant Examiner*—Richard A. Edgar

(57) ABSTRACT

A fan 10 includes a hub 12, a plurality of fan blades 14 attached to the hub at one end and extending outwardly from the hub, and a ring 18 concentric with the hub and coupled to tips 16 of the blades. A dimensionless radius (r/R) is defined from a center of the hub (r/R=0) radially outwardly, wherein each tip of the blades is r/R=1. A pitch ratio increases up to about r/R=0.85, and decreases in a range of about 0.85<r/R<1.0. In the range of about 0.6<r/R<1.0, a chord length decreases continually.

6 Claims, 2 Drawing Sheets

HIGH-FLOW LOW TORQUE FAN

This application is based on U.S. Provisional Application No. 60/453,119, filed on Mar. 7, 2003, and claims the benefit thereof for priority purposes.

FIELD OF THE INVENTION

The invention relates to a fan for moving a gas such as air and, more particularly, to a fan with multiple blades having a backwards-swept blade configuration with a specified blade pitch ratio.

BACKGROUND OF THE INVENTION

Typical fans for moving air have a multiple number of blades fixed rigidly to a hub and surrounded by a ring to produce air flow when rotating. The usual problems with these fans, especially ones of large size, are (1) axial deflection, and (2) the stress level under centrifugal loading. Axial deflection of the fan is undesirable for reasons of interference with other components as well as for aerodynamic and aeroacoustic reasons. High blade stresses can lead to catastrophic failure of the fan. In conventional fan configurations, to add strength to the fan, the chord length is increased to fix the tip to the surrounding ring. These configurations add material to the outermost radial sections of the blade in order to achieve increased strength. However, the added mass contributes to excessive axial deflection.

Accordingly, there is a need to provide a fan in which deflection is minimized and the strength of the fan is maximized by eliminating high stresses at critical areas.

SUMMARY OF THE INVENTION

In object of the invention is to fulfill the need referred to above. In accordance with the principles of the present invention, this objective is obtained by providing a fan including a hub, a plurality of fan blades attached to the hub at one end and extending outwardly from the hub, and a ring concentric with the hub and coupled to tips of the blades. A dimensionless radius (r/R) is defined from a center of the hub (r/R=0) radially outwardly, wherein each tip of the blades is r/R=1. A pitch ratio increases up to about r/R=0.85, and decreases in a range of about 0.85<r/R<1.0. In the range of about 0.6<r/R<1.0, a chord length decreases continually.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
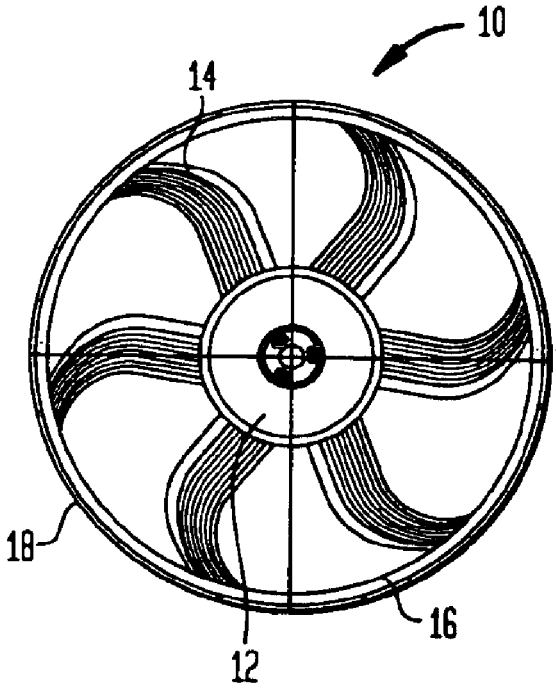
FIG. 1 is a front view of a fan provided in accordance with the principles of the present invention.

With reference to FIG. 1, a high-flow, low-torque fan is shown, generally indicated at 10, in accordance with the principles of the present invention. The fan 10 includes a circular hub 12, to which multiple blades 14 are attached circumferentially. The blade tips 16 are coupled to a ring 18 that is concentric with the hub 12. A dimensionless radius (r/R) is defined from the center of the hub 12 (this point is r/R=0) radially outwards, where the tip 16 of the blade (not counting the ring 18) is r/R=1. R is the radius of the fan from the center of the hub to the tip of the blade. Data for the fan of an embodiment is presented in the Table below and shown in plotted form in FIGS. 2 and 3.

| r/R | Pitch Ratio/ Average Pitch Ratio | Chord Length/Average Chord Length |
|---|---|---|
| 0.369 | 0.796 | 1.120 |
| 0.433 | 0.842 | 1.125 |
| 0.496 | 0.894 | 1.118 |
| 0.559 | 0.948 | 1.095 |
| 0.623 | 1.000 | 1.059 |
| 0.685 | 1.050 | 1.022 |
| 0.748 | 1.099 | 0.976 |
| 0.811 | 1.127 | 0.927 |
| 0.874 | 1.131 | 0.884 |
| 0.934 | 1.094 | 0.850 |
| 1.000 | 1.020 | 0.822 |

Figure 2:
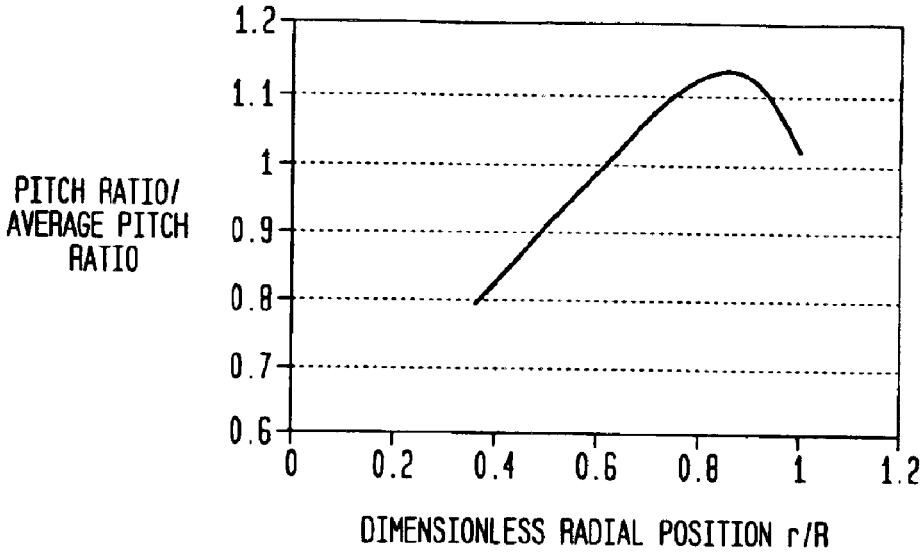
FIG. 2 is a graph of pitch ratio/average pitch ratio with respect to radial position r/R of the fan of the invention.
Figure 3:
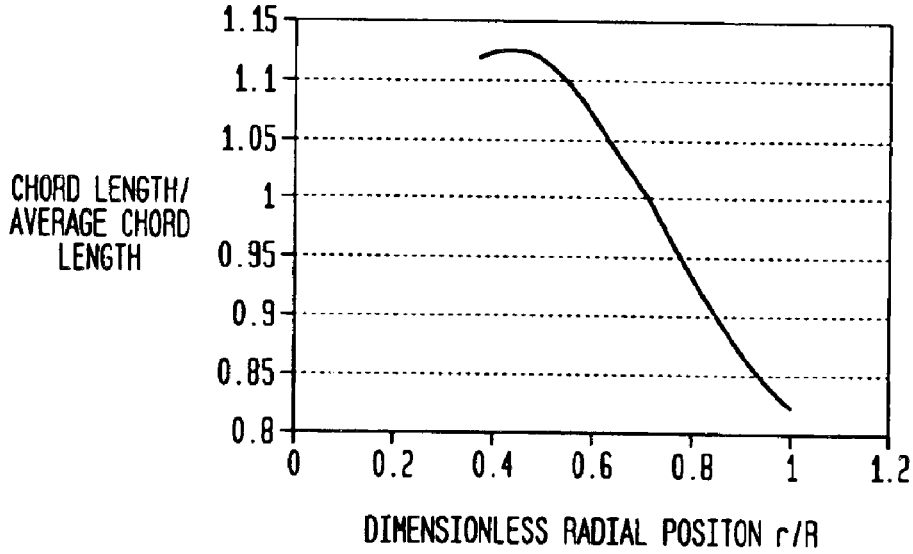
FIG. 3 is a graph of chord length/average cord length with respect to radial position r/R of the fan of the invention.

In general, the fan of the invention has the following features:

1) All the fan blades 14 are backwards-swept, that is, swept opposite to the direction of fan motion. However, in the range of about 0<r/R<0.6, zero sweep angle can be used.
(2) The pitch ratio increases up to about r/R=0.85, however, in the range of about 0.85<r/R<1.0, the pitch ratio decreases, as depicted in FIG. 2.
(3) In the range of about 0.6<r/R<1.0, the chord length decreases continually, as shown in FIG. 3.

The backwards-swept geometry, and the short chord length near the tip in combination with the pitch ratio configuration described in point (2) above produce a highly efficient and low noise fan. The decreased pitch ratio in the outermost regime of the blade helps to eliminate aerodynamic inefficiencies such as local swirl typically found in this area in conventional fan configurations. The sound magnitude emitted by the fan continually decreases with increasing flow rate through the fan in the positive pressure-producing range. This configuration is suitable for in vehicle applications where the downstream flow is nearly blocked. Typically, this occurs in tight engine compartments of vehicles, as the engine is in the direct downstream path of the air-stream generated by the fan. However, it can be applied to other applications where air needs to be moved.

The combination of the decreasing chord length, as stated in point (3) with the backwards-swept geometry as stated in point (1) result a minimized hanging mass distribution which help to neutralize stresses in critical areas, thus making the fan structurally sound. The maximum axial deflection of the fan is also very low which is critical in tight space operations. Therefore, the fan will not hit nearby components when in operation.

The fan configuration, in addition to points (1) through (3) can as well incorporate dihedral geometry of the blade as well as unevenly spaced blades.

The fan has a high strength and it has very low axial deflection in operation. In addition, it is mechanically efficient and has low noise characteristics suited for moving a gaseous state substance. The fan is operated to elevate pressure of incoming gas. Furthermore, when operated in a ram condition (decreased pressure across fan), the fluid dynamic drag is very low, which makes the fan is suitable for high volume flow throughput.

Typical use for this fan is automobile applications, especially those with high flow rate requirements and those applications where the fan has to withstand stresses due to rotations at high RPM levels.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fan comprising:

a hub, a plurality of fan blades attached to the hub at one end and extending outwardly from the hub, and a ring concentric with the hub and coupled to tips of the blades, wherein a dimensionless radius (r/R) is defined from a center of the hub (r/R=0) radially outwardly, wherein each tip of the blades is r/R=1, wherein a pitch ratio increases up to about r/R=0.85, and decreases in a range of about 0.85<r/R<1.0, and wherein, in the range of about 0.6<r/R<1.0, a chord length decreases continually.

2. The fan of claim 1, wherein all of the fan blades are backwards-swept.

3. The fan of claim 1, wherein the fan has a zero sweep angle in the range of about 0<r/R<0.6.

4. A fan comprising:

a hub, a plurality of fan blades attached to the hub at one end and extending outwardly from the hub, and a ring concentric with the hub and coupled to tips of the blades, the fan defined generally by:

| r/R | Pitch Ratio/ Average Pitch Ratio | Chord Length/Average Chord Length |
|---|---|---|
| 0.369 | 0.796 | 1.120 |
| 0.433 | 0.842 | 1.125 |
| 0.496 | 0.894 | 1.118 |
| 0.559 | 0.948 | 1.095 |
| 0.623 | 1.000 | 1.059 |
| 0.685 | 1.050 | 1.022 |
| 0.748 | 1.099 | 0.976 |
| 0.811 | 1.127 | 0.927 |
| 0.874 | 1.131 | 0.884 |
| 0.934 | 1.094 | 0.850 |
| 1.000 | 1.020 | 0.822 |

wherein (r/R) is a dimensionless radius defined from a center of the hub (r/R=0) radially outwardly, wherein each tip of the blades is r/R=1.

5. The fan of claim 4, wherein all of the fan blades are backwards-swept.

6. The fan of claim 4, wherein the fan has a zero sweep angle in the range of about 0<r/R<0.6.

* * * * *